United States Patent [19]

Oka

[11] 4,211,564

[45] Jul. 8, 1980

[54] CHEMICAL COPPER PLATING SOLUTION

[75] Inventor: Hitoshi Oka, Yokohama, Japan

[73] Assignee: Hitachi, Ltd., Japan

[21] Appl. No.: 31,160

[22] Filed: Apr. 18, 1979

Related U.S. Application Data

[63] Continuation-in-part of Ser. No. 904,322, May 9, 1978, abandoned.

[51] Int. Cl.[2] ..... C23C 3/02

[52] U.S. Cl. ..... 106/1.23; 106/1.26; 427/437; 427/98

[58] Field of Search ..... 106/1.23, 1.26; 427/430 A, 437

[56] References Cited

U.S. PATENT DOCUMENTS

| | | | |
|---|---|---|---|
| 3,515,563 | 6/1970 | Hodoley et al. | 106/1.23 |
| 3,804,638 | 4/1974 | Jonker et al. | 106/1.26 |
| 3,843,373 | 10/1974 | Molenaar et al. | 106/1.26 |
| 4,002,786 | 1/1977 | Hirohata et al. | 106/1.26 |

*Primary Examiner*—Lorenzo B. Hayes

*Attorney, Agent, or Firm*—Craig & Antonelli

[57] ABSTRACT

An aqueous plating solution consists essentially of a copper ion-releasing compound, a copper ion-complexing agent, a copper ion-reducing agent, a hydroxide of alkali metal, 2,2'-dipyridyl, polyethyleneglycolstearylamine, and silver sulfide has a good liquid stability and a high plating speed, and a chemical copper plating film obtained from the plating solution has a high toughness (tensile strength × elongation).

5 Claims, No Drawings

CHEMICAL COPPER PLATING SOLUTION

CROSS-REFERENCE OF THE INVENTION

This is a continuation-in-part application of U.S. patent application Ser. No. 904,322 filed May 9, 1978, now abandoned.

FIELD OF THE INVENTION

This invention relates to an aqueous chemical copper plating solution for print circuit board (for example, glass cloth-laminated epoxy resin print plate, and paper-laminated phenol resin substrate board) characterized by containing additives for improving mechanical properties of plating film and a plating speed, and stabilizing the plating solution.

DESCRIPTION OF THE PRIOR ART

The following chemical copper plating solutions are well known:

(a) a chemical copper plating solution comprising a water soluble copper salt, a complexing agent, a pH adjuster, a reducing agent, an additive (alkali metal sulfide), a surfactant (oxyethylated sodium salt), and an osmium-containing compound (U.S. Pat. No. 3,515,563), (b) a chemical copper plating solution comprising a water-soluble copper salt, a complex agent, a pH adjuster, a reducing agent, and a surfactant (polyalkylene oxide compound) (U.S. Pat. No. 3,804,638), and (c) a chemical copper plating solution comprising a water soluble copper salt, a complexing agent, a pH adjuster, a reducing agent, and an additive (2,2'-dipyridyl) (U.S. Pat. No. 4,002,786).

Furthermore, a chemical plating solution comprising a water soluble copper salt, a complexing agent, a pH adjuster, a reducing agent, 2,2'-dipyridyl, and a polyalkylene oxide compound is expectable from said solutions (a)–(c).

However, said chemical plating solutions (a)–(c) cannot produce a plating film having a satisfactory toughness (tensile strength×elongation), and, furthermore, said chemical plating solutions (b) and (c) have a poor stability.

SUMMARY OF THE INVENTION

An object of the present invention is to provide an aqueous chemical copper plating solution which is free from said disadvantages of the conventional chemical copper plating and is stable without a decomposition of the plating solution, and can produce a chemical copper plating film having excellent elongation and tensile strength as mechanical properties at a high plating speed.

As a result of extensive studies of chemical copper plating solutions, the present inventor has found that an aqueous chemical copper plating solution comprising a copper ion-releasing compound, a copper ion-complexing agent, a copper ion-reducing agent, a hydroxide of alkali metal, 2,2'-dipyridyl, a non-ionic surfactant of polyethyleneglycolalkylamine system and a metal sulfide can attain said object.

The chemical copper plating solution of the present invention has a better stability (that is, an ability of at least three repetitions) and a higher plating speed (for example, higher than 3.7μ/hr) than the conventional chemical copper plating solutions (a)–(c), and can produce a plating film having a better toughness (tensile strength×elongation>170) than said conventional chemical copper plating solutions (a)–(c).

Such effects can be attained only by using silver sulfide in the composition of said chemical copper plating solution (d). That is, it seems that silver sulfide is hardly soluble but forms colloidal particles in the plating solution, and the colloidal particles of silver sulfide take parts between the crystal particles in the plating film to weaken the inner stress of the film and enhance the toughness of the plating film. It seems that polyethyleneglycolstearylamine and 2,2'-dipyridyl contribute to the increase in plating speed and stability of the plating solution. Such effects are expectable not only from said individual prior art (a)–(c) alone, but also from a combination of the prior art (a)–(c), that is, said (d).

DETAILED DESCRIPTION OF PREFERRED EMBODIMENTS

Effects of said combination of the additives will be described in detail, referring to Examples.

EXAMPLE 1

Composition of a basic chemical copper plating solution except additives and plating condition are given in the following Table 1.

Table 1

| | |
|---|---|
| Plating solution composition | |
| $CuSO_4 \cdot 5H_2O$ | 12 g |
| EDTA-2Na | 35 g |
| Formalin (37%) | 6 ml |
| NaOH | 12 g |
| Water to make the entire solution | 1 l |
| Plating condition | |
| Plating temperature | 70° C. |

Mechanical properties of plating films and plating speeds obtained by chemical copper plating with said plating solution and chemical plating solutions prepared by adding said three kinds of the additives to said plating solution are given in Table 2. Test pieces of the plating films used for measuring their mechanical properties were prepared by depositing 30μ-thick platings on stainless steel plates, and peeling test pieces of plating film having a size of 1×10 cm off the plated stainless steel plates, and the test pieces of plating film were then subjected to the test by means of a tension tester. Plating speed was determined by measuring a weight of a film deposited within a predetermined time.

It is seen from Table 2 that when polyethyleneglycol stearylamine, silver sulfide and 2,2'-dipyridy are used together (No. 8), the toughness of the plating film and the plating speed are better than those obtained by adding one or two of these materials.

EXAMPLE 2

To determine the effect of the individual components in Table 2, No. 8, plating was carried out on substrates in the same manner as in Example 1 with individual chemical copper plating solutions of No. 1–No. 6 of each of Tables 3-1 to Table 3-4 and Table 3-6, and No. 1–No. 5 of Table 3-5. Plating speed and toughness of plating film were measured in the same manner as in Example 1, and also a stability of plating solution (repetition of plating) was investigated.

As the result, the following facts (a)–(g) were found.

(a) It is seen from Table 3-1 that an effective range of $Ag_2S$ to be added is $2.5\times10^{-5}$–5 g/l, preferably 0.01–0.5 g/l.

(b) It is seen from Table 3-2 that an effective range of 2,2'-dipyridyl to be added is 1–30 mg/l, preferably 5–20 mg/l.

(c) It is seen from Table 3-3 that an effective range of polyethyleneglycolstearylamine to be added is 5–500 mg/l, preferably 50–200 mg/l.

(d) It is seen from Table 3-4 that an effective range of 37% formalin is 1–10 ml/l, preferably 2–5 ml/l.

(e) It is seen from Table 3-5 that an effective range of pH is 11.9–12.8, preferably 11.9–12.5.

(f) It is seen from Table 3-6 that effective ranges of $CuSO_4.5H_2O$ and EDTA·2Na are 5–18 g/l of $CuSO_4.5H_2O$ and 15–54 g/l of EDTA·2Na, preferably 10–15 g/l of $CuSO_4.5H_2O$ and 30–45 g/l of EDTA·2Na.

(g) The individual plating solutions of No. 2–No. 5 of each of Table 3-1 to Table 3-4 and Table 3-6, and No. 2–No. 4 of Table 3-5 can undergo at least three repetitions of plating at a plating speed of higher than 3.7μ/hr.

From the foregoing results it is seen that a chemical copper plating solution consisting essentially of 5–18 g/l of $CuSO_4.5H_2O$, 15–54 g/l of EDTA·2Na, 1–10 ml/l of 37% formalin, 5–500 mg/l of polyethyleneglycolstearylamine, 1–30 mg/l of 2,2'-dipyridyl, $2.5\times10^{-15}$–5 g/l of $Ag_2S$ at a pH of 11.9–12.8, preferably a chemical copper plating solution consisting essentially of 10–15 g/l of $CuSO_4.5H_2O$, 30–45 g/l of EDTA·2Na, 2–5 ml/l of 37% formalin, 50–200 mg/l of polyethyleneglycolstearylamine, 5–20 mg/l of 2,2'-dipyridyl, and 0.01–0.5 g/l of $Ag_2S$ at a pH of 11.9–12.5, is effective.

$Ag_2S$ can be directly added to the plating solution, but can be preferably placed in a container made of colloidal particle-permeable polyethylene, nonwoven fabric. The amount of $Ag_2S$ to be added can be more than 5 g/l, which is however not economical, and less than $2.5\times10^{-15}$ g/l of $Ag_2S$ is less effective.

EXAMPLE 3

Chemical copper plating solutions prepared by dissolving $Ag_2S$, $K_2S$, $Na_2S$, $Cu_2S$, CuS, SnS or $MoS_2$ in a solution consisting essentially of 13 g/l of $CuSO_4.5H_2O$, 40 g/l of EDTA·2Na, 3 ml/l of 37% formalin, 100 mg/l of polyethyleneglycolstearylamine and 10 mg/l of 2,2'-dipyridyl at a pH of 12.3, as shown in Table 4, and the chemical copper plating solution of Table 1 were subjected to plating on substrates in the same manner as in Example 1. The results are given in Table 4, where it is shown that the plating film obtained from the chemical copper plating solution containing $Ag_2S$ had a better toughness (tensile strength×elongation) than those of the plating films obtained from other plating solutions, which had also a poor plating speed and a poor ability of repetition of plating.

COMPARATIVE EXAMPLE

Plating was carried out on substrates in the same manner as in Example 1, using chemical plating solutions prepared by adding additives of Table 5 to the basic plating solution of Table 1. The results are shown in Table 5. It is seen that the resulting plating films had a poor toughness (tensile strength×elongation), and a poor plating speed and a poor ability of repetition of plating.

Table 2

| | Additive | | | Mechanical properties | | | |
|---|---|---|---|---|---|---|---|
| Case No. | PEG . SA* (50 mg/l) | $Ag_2S$** (0.5 g/l) | 2,2'-dipyridyl (20 mg/l) | Elongation (a) (%) | Tensile strength (b) (kg/mm²) | Approximate toughness (a) × (b) | Plating speed (μ/hr) |
| 1 | — | — | — | 1.6 | 44.7 | 72 | 1.6 |
| 2 | 0 | — | — | 2.1 | 48.9 | 103 | 1.7 |
| 3 | — | 0 | — | 2.0 | 39.2 | 78 | 3.0 |
| 4 | — | — | 0 | 2.5 | 36.0 | 90 | 3.6 |
| 5 | — | 0 | 0 | 2.7 | 30.0 | 81 | 3.3 |
| 6 | 0 | 0 | — | 3.6 | 47.3 | 170 | 3.5 |
| 7 | 0 | — | 0 | 3.5 | 30.8 | 108 | 3.0 |
| 8 | 0 | 0 | 0 | 4.5 | 45.0 | 203 | 3.8 |

Remarks:
Mark "0": The relevant additive is contained in or contacted with the relevant plating solution
"—": The relevant additive is neither contained in nor contacted with the relevant plating solution.
*: Abbreviation of polyethyleneglycolstearylamine (number of ethoxy group: 15, degree of polymerization n = 15)
**: Powdery $Ag_2S$ is always brought in contact with the plating solution tostabilize the plating solution.

Table 3-1

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-dipyridyl (mg/l) | $Ag_2S$ (g/l) |
| 1 | 13 | 40 | 12.3 | 3 | 100 | 10 | 0 |
| 2 | " | " | " | " | " | " | $2.5\times10^{-5}$ |
| 3 | " | " | " | " | " | " | 0.01 |
| 4 | " | " | " | " | " | " | 0.5 |
| 5 | " | " | " | " | " | " | 5 |
| 6 | " | " | " | " | " | " | 30 |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 3.3 | 29.2 | 96 | 3.0 | 30.1 | 90 | 2.4 | 35.8 | 86 |
| 5.0 | 38.9 | 195 | 4.8 | 36.0 | 173 | 4.5 | 40.2 | 181 |
| 5.9 | 38.9 | 230 | 5.4 | 40.0 | 216 | 4.8 | 40.2 | 193 |

Table 3-1-continued

| | | | | | | | | |
|---|---|---|---|---|---|---|---|---|
| 6.7 | 48.1 | 322 | 6.0 | 49.7 | 298 | 6.3 | 48.9 | 308 |
| 4.1 | 48.9 | 200 | 4.0 | 45.5 | 182 | 3.7 | 50.0 | 185 |
| 3.1 | 51.3 | 159 | 2.3 | 58.2 | 134 | 2.0 | 59.4 | 119 |

(a): Elongation (%),
(b): tensile strength (kg/mm$^2$)
PEG . SA: polyethyleneglycolstearylamine (number of epoxy group: 15, degree of polymerization n = 15)

Table 3-2

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-di-pyridyl (mg/l) | $Ag_2S$ (g/l) |
| 1 | 13 | 40 | 12.3 | 3 | 100 | 0.5 | 0.3 |
| 2 | " | " | " | " | " | 1 | " |
| 3 | " | " | " | " | " | 5 | " |
| 4 | " | " | " | " | " | 20 | " |
| 5 | " | " | " | " | " | 30 | " |
| 6 | " | " | " | " | " | 50 | " |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 2.5 | 32.4 | 81 | Impossible to measure | | | | | |
| 3.8 | 48.1 | 183 | 3.5 | 53.6 | 188 | 3.3 | 55.2 | 182 |
| 7.6 | 49.1 | 373 | 6.6 | 52.7 | 348 | 5.9 | 53.0 | 313 |
| 4.9 | 46.1 | 226 | 4.6 | 49.4 | 227 | 4.7 | 50.6 | 238 |
| 4.6 | 38.2 | 176 | 4.5 | 40.0 | 180 | 4.1 | 42.1 | 173 |
| 4.7 | 22.6 | 106 | 4.2 | 28.4 | 119 | Impossible to measure | | |

(a): Elongation (%),
(b): Tensile strength (kg/mm$^2$)
PEG . SA: polyethyleneglycolstearylamine (number of ethoxy groups: 15, degree of polymerization n = 15)

Table 3-3

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-di-pyridyl (mg/l) | $Ag_2S$ (g/l) |
| 1 | 13 | 40 | 12.3 | 3 | 1 | 10 | 0.3 |
| 2 | " | " | " | " | 5 | " | " |
| 3 | " | " | " | " | 50 | " | " |
| 4 | " | " | " | " | 200 | " | " |
| 5 | " | " | " | " | 500 | " | " |
| 6 | " | " | " | " | 1000 | " | " |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 2.7 | 28.9 | 78 | Impossible to measure | | | | | |
| 4.2 | 42.1 | 177 | 3.8 | 49.8 | 189 | 3.3 | 55.5 | 183 |
| 5.7 | 51.8 | 295 | 4.8 | 55.4 | 266 | 4.9 | 59.3 | 291 |
| 6.8 | 45.9 | 312 | 6.2 | 49.3 | 306 | 5.8 | 54.2 | 314 |
| 5.0 | 38.9 | 195 | 4.8 | 36.0 | 173 | 4.5 | 40.2 | 181 |
| 3.0 | 30.6 | 92 | 2.7 | 28.4 | 77 | Impossible to measure | | |

(a): Elongation (%),
(b): Tensile strength (kg/mm$^2$)
PEG . SA: polyethyleneglycolstearylamine (number of ethoxy group: 15, degree of polymerization n = 15)

Table 3-4

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-di-pyridyl (mg/l) | $Ag_2S$ (g/l) |
| 1 | 13 | 34 | 12.3 | 0.5 | 100 | 10 | 0.3 |
| 2 | " | " | " | 1 | " | " | " |
| 3 | " | " | " | 2 | " | " | " |
| 4 | " | " | " | 5 | " | " | " |
| 5 | " | " | " | 10 | " | " | " |
| 6 | " | " | " | 15 | " | " | " |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 2.2 | 55.1 | 121 | 1.8 | 59.1 | 106 | 1.6 | 45.0 | 72 |
| 3.6 | 48.6 | 175 | 3.3 | 52.4 | 173 | 3.1 | 58.4 | 181 |

Table 3-4-continued

| | | | | | | | | |
|---|---|---|---|---|---|---|---|---|
| 5.9 | 49.3 | 291 | 5.4 | 50.6 | 273 | 4.9 | 55.7 | 273 |
| 6.6 | 44.4 | 293 | 6.3 | 48.2 | 304 | 5.6 | 50.4 | 282 |
| 5.3 | 38.1 | 202 | 5.2 | 38.3 | 199 | 4.2 | 43.1 | 181 |
| 3.0 | 38.2 | 115 | | | Impossible to measure | | | |

(a): Elongation (%),
(b): Tensile strength (kg/mm$^2$)
PEG . SA: polyethyleneglycolstearylamine (number of ethoxy group: 15, degree of polymerization n = 15)

Table 3-5

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-dipyridyl (mg/l) | $Ag_2S$ (g/l) |
| 1 | 13 | 40 | 11.8 | 3 | 100 | 10 | 0.3 |
| 2 | " | " | 11.9 | " | " | " | " |
| 3 | " | " | 12.5 | " | " | " | " |
| 4 | " | " | 12.8 | " | " | " | " |
| 5 | " | " | 13.2 | " | " | " | " |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 1.9 | 60.1 | 114 | | | Impossible to measure | | | |
| 4.2 | 54.1 | 227 | 4.2 | 57.1 | 240 | 3.8 | 60.4 | 230 |
| 6.1 | 43.3 | 264 | 6.0 | 44.7 | 268 | 5.3 | 59.1 | 313 |
| 4.7 | 37.1 | 174 | 3.8 | 45.3 | 172 | 3.1 | 55.5 | 172 |
| 2.8 | 31.6 | 88 | | | Impossible to measure | | | |

(a): Elongation (%),
(b): Tensile strength (kg/mm$^2$)
PEG . SA: polyethyleneglycolstearylamine (number of ethoxy group: 15, degree of polymerization n = 15)

Table 3-6

| | Composition of plating solution | | | | | | |
|---|---|---|---|---|---|---|---|
| No. | $CuSO_4 . 5H_2O$ (g/l) | EDTA . 2Na (g/l) | pH (NaOH) | 37% HCHO (ml/l) | PEG . SA (mg/l) | 2,2'-dipyridyl (mg/l) | $Ag_2S$ (g/l) |
| 1 | 3 | 9 | 12.2 | 3 | 100 | 10 | 0.3 |
| 2 | 5 | 15 | " | " | " | " | " |
| 3 | 10 | 30 | " | " | " | " | " |
| 4 | 15 | 45 | " | " | " | " | " |
| 5 | 18 | 54 | " | " | " | " | " |
| 6 | 25 | 75 | " | " | " | " | " |

| Repetition of plating | | | | | | | | |
|---|---|---|---|---|---|---|---|---|
| First | | | Second | | | Third | | |
| (a) | (b) | (a) × (b) | (a) | (b) | (a) × (b) | (a) | (b) | (a) × (b) |
| 1.6 | 57.3 | 92 | | | Impossible to measure | | | |
| 3.5 | 51.8 | 181 | 3.2 | 55.4 | 177 | 2.9 | 59.3 | 172 |
| 6.6 | 47.3 | 312 | 6.5 | 50.0 | 325 | 5.9 | 53.9 | 318 |
| 6.7 | 46.8 | 314 | 6.3 | 51.4 | 324 | 6.1 | 54.8 | 334 |
| 5.3 | 42.1 | 223 | 4.2 | 44.3 | 186 | 3.8 | 47.2 | 179 |
| 2.6 | 38.6 | 100 | | | Impossible to measure | | | |

(a): Elongation (%),
(b): Tensile strength (kg/mm$^2$)
PEG . SA: polyethyleneglycolstearylamine (number of ethoxy group: 15, degree of polymerization n = 15)

Table 4

| Item | Sulfides | None | $K_2S$ | $Na_2S$ | $Ag_2S$ | $Cu_2S$ | CuS | SnS | $MoS_2$ |
|---|---|---|---|---|---|---|---|---|---|
| $S^{2-}$concentration calculated from solubility product | Solubility product | — | ∞ | ∞ | $10^{-51}$ | $10^{-48}$ | $8 \times 10^{-36}$ | $8 \times 10^{-29}$ | Insoluble |
| | Equilibrium $S^{2-}$concentration (g/l) | — | ∞ | ∞ | $3 \times 10^{-16}$ | $3 \times 10^{-15}$ | $9 \times 10^{-17}$ | $3 \times 10^{-13}$ | |
| Equilibrium $S^{2-}$concentration | (a) (%) | 3.5 | 3.3 | 2.9 | 6.7 | 1.7 | Impossible to plate | Impossible to plate | 3.4 |
| | (b) (kg/mm$^2$) | 30.6 | 49.8 | 52.5 | 48.1 | 52.3 | | | 28.4 |
| | (a) × (b) | 107 | 164 | 152 | 322 | 89 | — | — | 97 |
| Plating speed (μ/hr) | | 1.6 | 3.0 | 3.0 | 3.8 | 1.7 | — | — | 1.6 |
| Repetitions of plating | | 1 | 1 | 1 | at least | 1 | — | — | 1 |

Table 4-continued

| Item | Sulfides None | $K_2S$ | $Na_2S$ | $Ag_2S$ | $Cu_2S$ | CuS | SnS | $MoS_2$ |
|---|---|---|---|---|---|---|---|---|
| | | | | 3 | | | | |

(a): Elongation,
(b): Tensile strength,
(a) × (b): Toughness
∞: much dissolved.

Table 5

| No. | Additive (1) | Additive (2) | Additive (3) | Plating speed (μ/hr) | Film Properties (a) (%) | (b) (kg/mm²) | (a) × (b) | Repetition ability of plating |
|---|---|---|---|---|---|---|---|---|
| 1 | Polyethylene Glycol Monooleyl Ether (n = 20) 20 mg/l | 2,2'-Biquinolyl 5 mg/l | $K_2S$ 0.1 mg/l | 1.8 | 3.0 | 43.9 | 132 | 1 |
| 2 | Emphos PS-400 100 mg/l | 2,2'-Dipyridyl 5 mg/l | $K_2S$ 0.1 mg/l | 1.3 | 1.7 | 30.1 | 51 | 1 |
| 3 | Emphos PS-400 100 mg/l | 1,10-phenanthroline 0.1 mg/l | — | 2.5 | 2.5 | 45.4 | 114 | 1 |
| | Carbowax (600) 10 ml/l | 2,2'-Dipyridyl 10 mg/l | — | 2.8 | 3.0 | 26.3 | 79 | 2 |

(a): Elongation,
(b): Tensile strength,
Emphos: phosphate ester based on ethoxylated linear alcohol (Witco Chemical Co.)
n: Number of ethoxy group, degree of polymerization.

What is claimed is:

1. In an aqueous chemical copper plating solution which consists essentially of a water soluble copper salt, a complex agent, a reducing agent, a hydroxide of alkali metal, surfactant, 2,2'-dipyridyl the improvement consisting of silver sulfide in an amount sufficient to provide a chemical copper plating solution having a better stability and higher plating speed and to provide a tougher plating film than conventional chemical copper plating solutions.

2. An aqueous chemical copper solution according to claim 1, wherein the surfactant is polyethyleneglycolstearylamine.

3. An aqueous chemical copper plating solution which consists essentially of $CuSO_4.5H_2O$, EDTA·2Na, formalin, NaOH, polyethyleneglycolstearylamine, 2,2-dipyridyl and silver sulfide.

4. An aqueous chemical copper plating solution which consists essentially of 5–18 g/l of $CuSO_4.5H_2O$, 15–54 g/l of EDTA·2Na, 1–10 ml/l of 37% formalin, 5–500 mg/l of polyethyleneglycolstearylamine, 1–30 mg/l of 2,2'-dipyridyl and $2.5\times10^{-15}$ g/l–5 g/l of $Ag_2S$ at a pH of 11.9–12.8.

5. An aqueous chemical copper plating solution which consists essentially of 10–15 g/l of $CuSO_4.5H_2O$, 30–45 g/l of EDTA 2Na, 2–5 ml/l of 37% formalin, 50–200 mg/l of polyethyleneglycolstearylamine, 5–20 mg/l of 2,2'-dipyridyl and 0.01–0.5 g/l of $Ag_2S$ at a pH of 11.9–12.5.

* * * * *